US011986696B2

(12) United States Patent
Kuo

(10) Patent No.: US 11,986,696 B2
(45) Date of Patent: May 21, 2024

(54) PEDAL OF AN EXERCISER

(71) Applicant: Sports Art Industrial Co., Ltd., Tainan (TW)

(72) Inventor: Hai-Pin Kuo, Tainan (TW)

(73) Assignee: Sports Art Industrial Co., Ltd., Tainan (TW)

( * ) Notice: Subject to any disclaimer, the term of this patent is extended or adjusted under 35 U.S.C. 154(b) by 218 days.

(21) Appl. No.: 17/730,966

(22) Filed: Apr. 27, 2022

(65) Prior Publication Data

US 2022/0355159 A1 Nov. 10, 2022

(51) Int. Cl.
*A63B 22/00* (2006.01)
*A63B 21/00* (2006.01)
*A63B 22/06* (2006.01)

(52) U.S. Cl.
CPC ..... *A63B 22/0046* (2013.01); *A63B 21/4034* (2015.10); *A63B 22/0664* (2013.01); *A63B 2225/09* (2013.01)

(58) Field of Classification Search
CPC ..... A63B 21/4034; A63B 22/0046; A63B 22/0664; A63B 2225/09
See application file for complete search history.

(56) References Cited

U.S. PATENT DOCUMENTS

| | | | | |
|---|---|---|---|---|
| 5,221,242 | A * | 6/1993 | Weber | A63B 23/08 482/79 |
| 5,645,516 | A * | 7/1997 | Foster | A63B 23/085 482/121 |
| 6,231,485 | B1 * | 5/2001 | Dreissigacker | A63B 22/0076 482/57 |
| 6,730,003 | B1 * | 5/2004 | Phillips | A63B 21/0616 482/57 |
| 8,337,369 | B1 * | 12/2012 | Jacobson | A63B 25/00 482/76 |
| 8,360,940 | B2 * | 1/2013 | Kole | A63B 21/0552 482/79 |
| 9,132,308 | B2 * | 9/2015 | Kole | A63B 21/028 |
| 9,220,941 | B2 * | 12/2015 | Barry | A63B 21/4017 |
| 10,434,357 | B2 * | 10/2019 | McCarthy | A63B 21/0552 |
| 11,103,740 | B2 * | 8/2021 | Boyles | A63B 21/4035 |
| 11,806,572 | B2 * | 11/2023 | Boyles | A63B 22/0076 |
| 2019/0160322 | A1 * | 5/2019 | McCarthy | A63B 21/4034 |

* cited by examiner

*Primary Examiner* — Joshua Lee

(57) ABSTRACT

A pedal of an exerciser contains: a body and a fitting sleeve. The body includes multiple slots parallelly defined on the body, and the body includes a first slide rail and a second slide rail symmetrically formed on two sides of the body. The fitting sleeve includes a connection portion received in the multiple slots, a first rotatable seat and a second rotatable seat symmetrically fixed on two sides of the fitting sleeve. The first rotatable seat has a first receiving orifice, and the second rotatable seat has a second receiving orifice, such that a coupling bolt is inserted through the first receiving orifice of the first rotatable seat, the first slide rail of the body, the second slide rail of the body, and the second receiving orifice of the second rotatable seat. Thereafter, the coupling bolt is locked by two first defining elements and two second defining elements.

2 Claims, 6 Drawing Sheets

PEDAL OF AN EXERCISER

FIELD OF THE INVENTION

The present invention relates to a pedal of an exerciser by which the connection portion of the fitting sleeve is movably adjusted to a desired position of the multiple slots of the body based on a size of the user's foot.

BACKGROUND OF THE INVENTION

A conventional exerciser is applied to train and muscles and exercise. The conventional exerciser is any one of exercise treadmills, step machines, rowing machines, and bicycles.

The exerciser having a pedal contains a body and a fixing band configured to tie a user's foot. However, such a conventional exerciser cannot movably adjust the user's foot to a desired position of the body based on a size of the user's foot.

The present invention has arisen to mitigate and/or obviate the afore-described disadvantages.

SUMMARY OF THE INVENTION

The primary aspect of the present invention is to provide a pedal of an exerciser by which the connection portion of the fitting sleeve is movably adjusted to a desired position of the multiple slots of the body based on a size of the user's foot, thereafter the fixing band ties the user's foot on the body, thus fixing the user's foot on the body securely and easily.

To obtain above-mentioned aspect, a pedal of an exerciser provided by the present invention contains: a body and a fitting sleeve.

The body includes multiple slots parallelly defined on a top of the body, and the body includes a first slide rail and a second slide rail symmetrically formed on two sides of the body.

The fitting sleeve includes a connection portion received in the multiple slots of the body, a first rotatable seat and a second rotatable seat symmetrically fixed on two sides of the fitting sleeve.

The first rotatable seat has a first receiving orifice, and the second rotatable seat has a second receiving orifice, such that a coupling bolt is inserted through the first receiving orifice of the first rotatable seat of the fitting sleeve, the first slide rail of the body, the second slide rail of the body, and the second receiving orifice of the second rotatable seat of the fitting sleeve. Thereafter, the coupling bolt is locked by two first defining elements and two second defining elements.

DETAILED DESCRIPTION OF THE PREFERRED EMBODIMENTS

Figure 1:
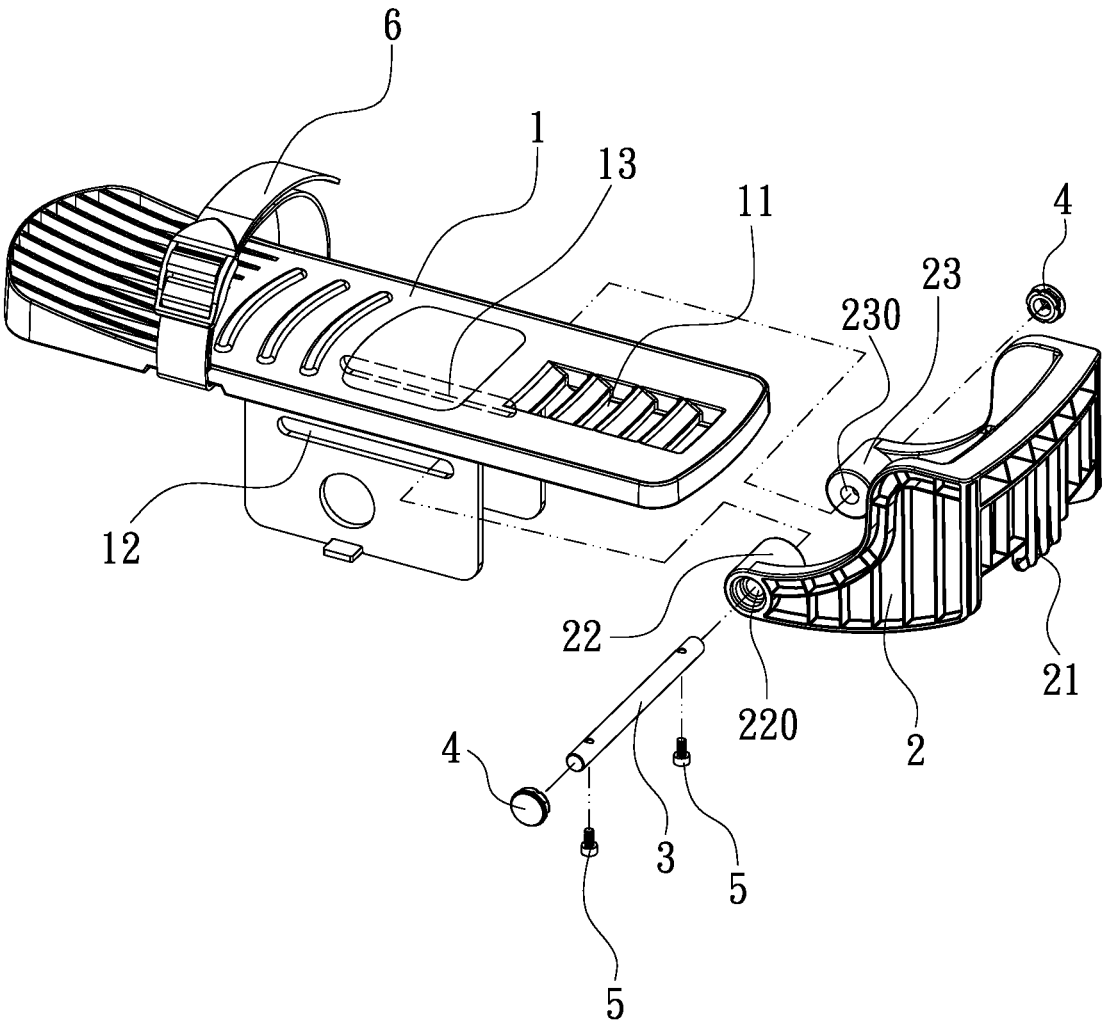
FIG. 1 is a perspective view showing the exploded components of a pedal of an exerciser according to a preferred embodiment of the present invention.
Figure 2:
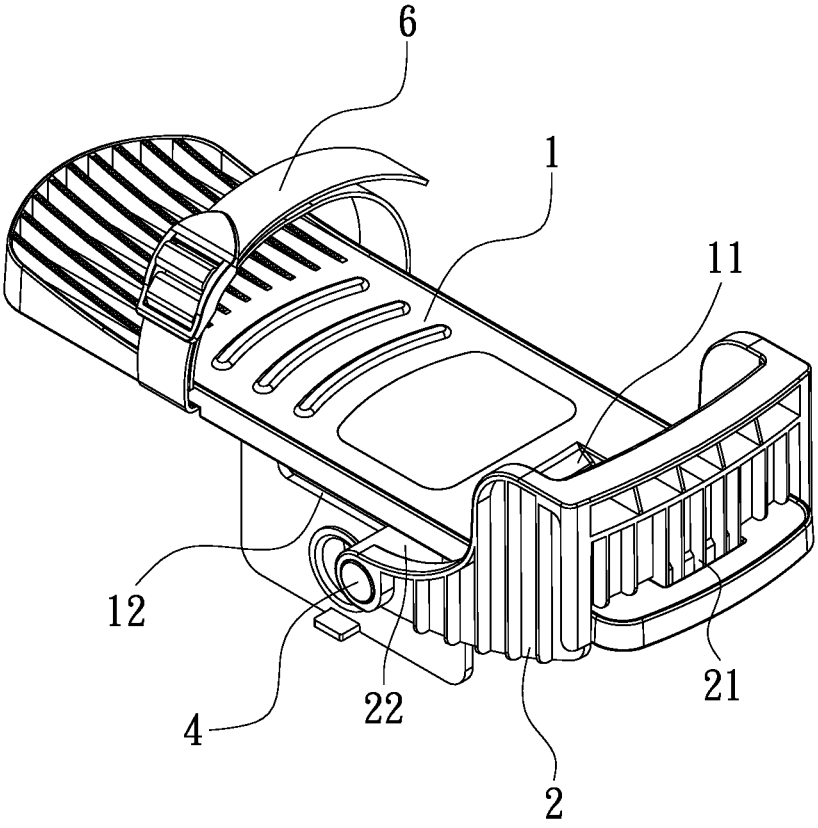
FIG. 2 is a perspective view showing the assembly of the pedal of the exerciser according to the preferred embodiment of the present invention.
Figure 3:
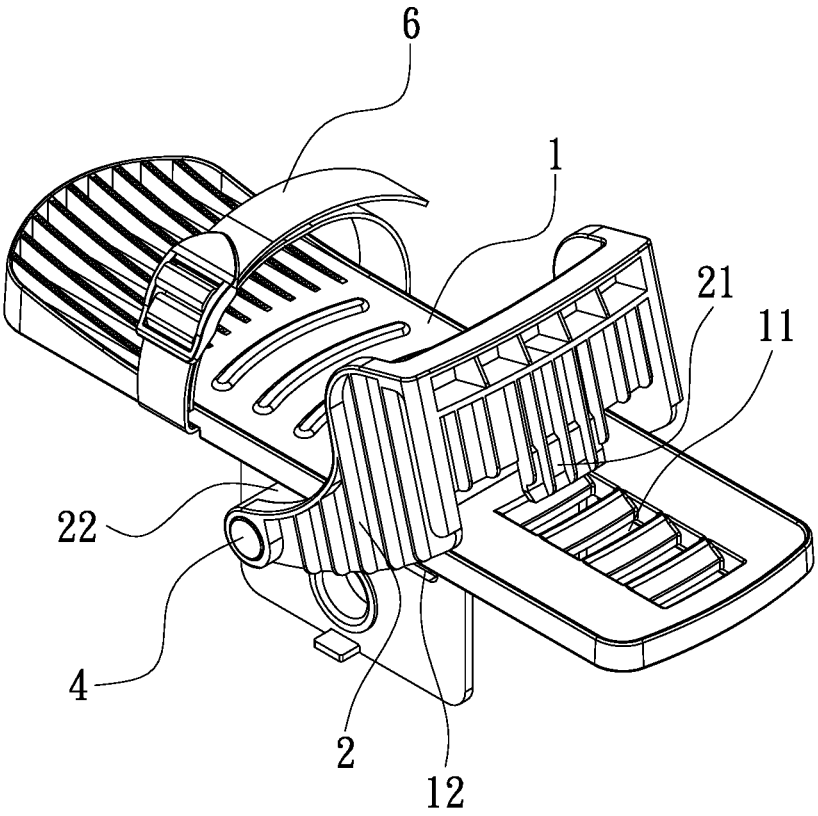
FIG. 3 is a perspective view showing the operation of the pedal of the exerciser according to the preferred embodiment of the present invention.
Figure 4:
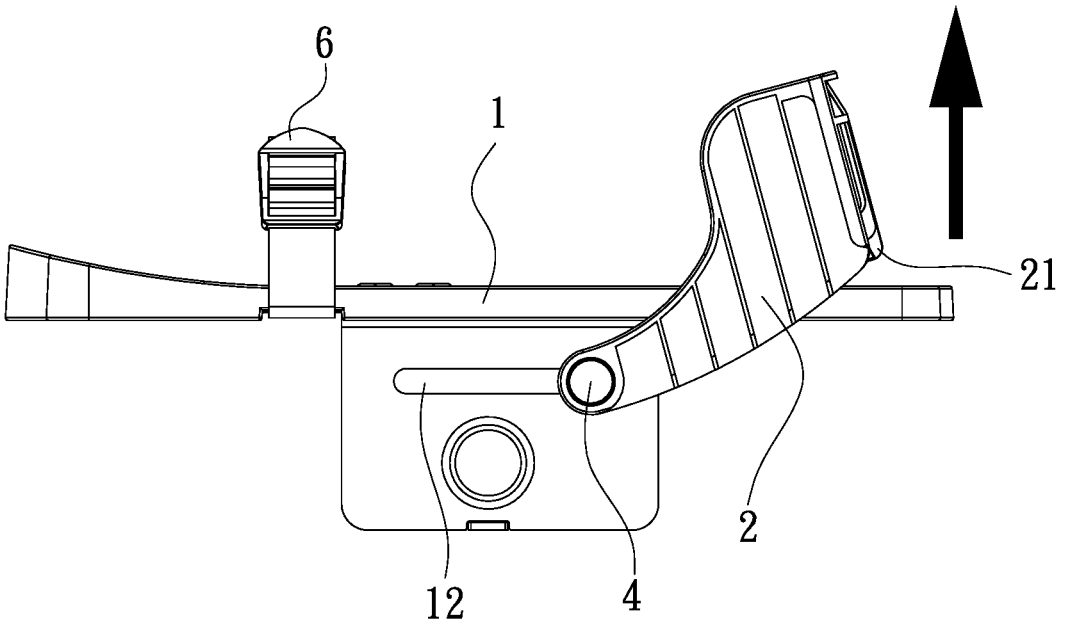
FIG. 4 is a side plan view showing the operation of the pedal of the exerciser according to the preferred embodiment of the present invention.
Figure 5:
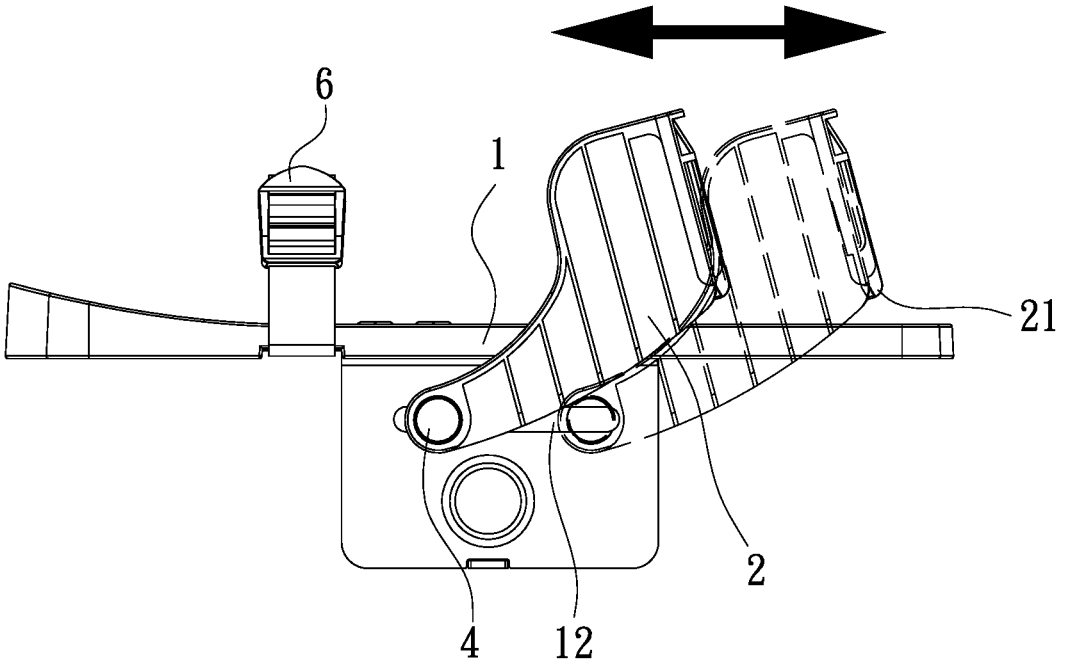
FIG. 5 is another side plan view showing the operation of the pedal of the exerciser according to the preferred embodiment of the present invention.
Figure 6:
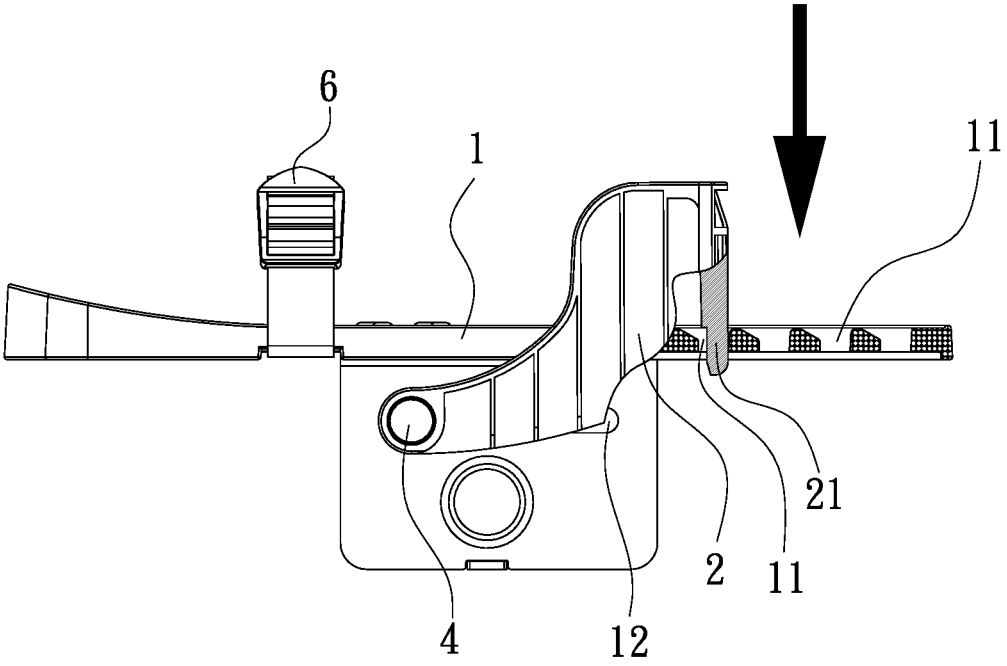
FIG. 6 is also another side plan view showing the operation of the pedal of the exerciser according to the preferred embodiment of the present invention.

With reference to FIGS. 1 and 2, a pedal of an exerciser according to a preferred embodiment of the present invention comprises: a body 1, a connection sleeve 2, and a fixing band 6.

The body 1 includes multiple slots 11 parallelly defined on a top thereof, and the body 1 includes a first slide rail 12 and a second slide rail 13 symmetrically formed on two sides of the body 1.

The fitting sleeve 2 includes a connection portion 21 received in the multiple slots 11 of the body 1, a first rotatable seat 22 and a second rotatable seat 23 symmetrically fixed on two sides of the fitting sleeve 2, wherein the first rotatable seat 22 has a first receiving orifice 220, and the second rotatable seat 23 has a second receiving orifice 230, such that a coupling bolt 3 is inserted through the first receiving orifice 220 of the first rotatable seat 22 of the fitting sleeve 2, the first slide rail 12 of the body 1, the second slide rail 13 of the body 1, and the second receiving orifice 230 of the second rotatable seat 23 of the fitting sleeve 2, thereafter the coupling bolt 3 is locked by two first defining elements 4 and two second defining elements 5.

The fixing band 6 is mounted on the body 1 to tie a user's foot.

Referring to FIGS. 3-6, in operation, the connection portion 21 of the fitting sleeve 2 is accommodated in the multiple slots 11 of the body 1, and the fitting sleeve 2 is moved along the first slide rail 12 and the second slide rail 13 of the body 1 so as to movably adjust the connection portion 21 of the fitting sleeve 2 to a desired position of the multiple slots 11 of the body 1 based on a size of the user's foot, thereafter the fixing band 6 ties the user's foot on the body 1, thus fixing the user's foot on the body 1 securely and easily.

Thereby, the body 1 includes the multiple slots 11, the first slide rail 12 and the second slide rail 13, and the fitting sleeve 2 is movably fixed in the first slide rail 12 and the second slide rail 13. The fitting sleeve 2 is movably adjusted to the desired position of the multiple slots 11 of the body 1 based on the size of the user's foot, and the fixing band 6 ties the user's foot on the body 1, thus fixing the user's foot on the body 1 securely and easily.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A pedal of an exerciser comprising:

a body including multiple slots parallelly defined on a top of the body, and the body including a first slide rail and a second slide rail symmetrically formed on two sides of the body; and a fitting sleeve including a connection portion received in the multiple slots of the body, a first rotatable seat and a second rotatable seat symmetrically fixed on two sides of the fitting sleeve;

wherein the first rotatable seat has a first receiving orifice, and the second rotatable seat has a second receiving orifice, such that a coupling bolt is inserted through the first receiving orifice of the first rotatable seat of the fitting sleeve, the first slide rail of the body, the second slide rail of the body, and the second receiving orifice of the second rotatable seat of the fitting sleeve, thereafter the coupling bolt is locked by two first defining elements and two second defining elements.

2. The pedal of the exerciser as claimed in claim 1 further comprising a fixing band mounted on the body to tie a user's foot.

* * * * *